US007322497B2

(12) United States Patent
Redlin

(10) Patent No.: US 7,322,497 B2
(45) Date of Patent: Jan. 29, 2008

(54) COVERING FOR AN INFLATABLE BODY OF AN APPARATUS FOR PRESSING ITEMS OF CLOTHING, AND APPARATUS FOR PRESSING ITEMS OF CLOTHING EQUIPPED WITH THE COVERING

(75) Inventor: Kathrin Redlin, Berlin (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 276 days.

(21) Appl. No.: 10/852,961

(22) Filed: May 24, 2004

(65) Prior Publication Data

US 2004/0222250 A1 Nov. 11, 2004

Related U.S. Application Data

(63) Continuation of application No. PCT/EP02/12587, filed on Nov. 11, 2002.

(30) Foreign Application Priority Data

Nov. 22, 2001 (DE) ..... 101 57 242

(51) Int. Cl.
*D06F 73/00* (2006.01)
*D06F 71/36* (2006.01)
*D06F 83/00* (2006.01)

(52) U.S. Cl. ..... 223/70; 38/66

(58) Field of Classification Search ..... 223/66, 223/67, 68, 70, 72, 73, 74, 76; 38/66, 64, 38/63, 140

See application file for complete search history.

(56) References Cited

U.S. PATENT DOCUMENTS

| | | | | |
|---|---|---|---|---|
| 2,679,339 | A * | 5/1954 | McLagan | 223/57 |
| 2,990,983 | A * | 7/1961 | Jackson | 223/67 |
| 3,262,615 | A * | 7/1966 | Killey | 223/67 |
| 3,286,889 | A | 11/1966 | Schlemon | |
| 3,326,427 | A | 6/1967 | Schlemon | |
| 3,333,747 | A * | 8/1967 | Glover, Jr. | 223/70 |
| 3,385,485 | A * | 5/1968 | Aloi | 223/70 |
| 3,512,703 | A * | 5/1970 | Buckley et al. | 223/70 |
| 3,568,900 | A * | 3/1971 | Paris | 223/70 |
| 4,303,183 | A | 12/1981 | Schlemon | |
| 5,148,955 | A * | 9/1992 | Cares | 223/70 |
| 5,555,648 | A * | 9/1996 | Griffin | 34/621 |
| 5,819,446 | A * | 10/1998 | Pearl et al. | 38/66 |

FOREIGN PATENT DOCUMENTS

| | | |
|---|---|---|
| DE | 35 14 552 A1 | 10/1986 |
| DE | 199 07 929 A1 | 8/2000 |
| DE | 199 13 642 A1 | 9/2000 |
| EP | 1 069 231 A2 | 1/2001 |

* cited by examiner

*Primary Examiner*—Ismael Izaguirre
(74) *Attorney, Agent, or Firm*—Russell W. Warnock; James E. Howard

(57) ABSTRACT

Items of clothing, such as dress shirts, may be smoothed or pressed by pulling them taut from within by way of an inflatable body that is linked with a base that is provided with a fan for inflating the inflatable body. In order to partially or completely prevent the inflatable body from being worn down, a covering is provided for the inflatable body, which is air-permeable across at least a part of its surface. The covering can be produced at substantially lower costs than the inflatable body so that it can be washed more often, while accepting the wear and tear thereby caused, since the covering can be replaced at a low cost. The covering may have a different shape and/or smaller dimensions in order to adapt to the type of the item of clothing to be smoothened.

19 Claims, 2 Drawing Sheets

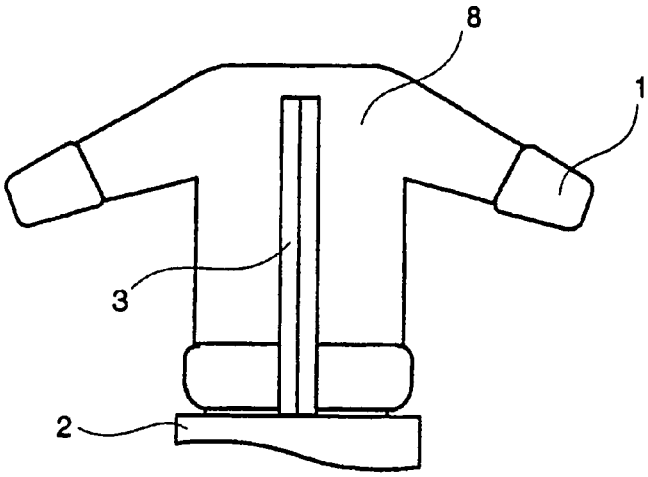
FIG. 3
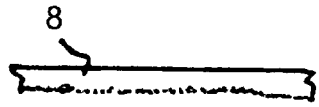
FIG. 5
FIG. 6
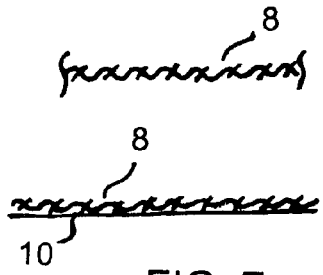
FIG. 7
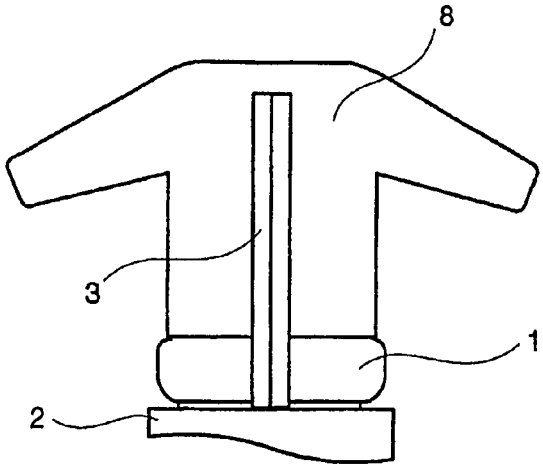
FIG. 4

COVERING FOR AN INFLATABLE BODY OF AN APPARATUS FOR PRESSING ITEMS OF CLOTHING, AND APPARATUS FOR PRESSING ITEMS OF CLOTHING EQUIPPED WITH THE COVERING

CROSS-REFERENCE TO RELATED APPLICATION

This application is a continuation, under 35 U.S.C. § 120, of copending international application No. PCT/EP02/12587, filed Nov. 11, 2002, which designated the United States; this application also claims the priority, under 35 U.S.C. § 119, of German patent application No. 101 57 242.5, filed Nov. 22, 2001; the prior applications are herewith incorporated by reference in their entirety.

BACKGROUND OF THE INVENTION

Field of the Invention

The invention relates to an auxiliary device for an inflatable body of an apparatus for pressing items of clothing, and to an apparatus for pressing items of clothing with an inflatable body.

German published patent application DE 199 13 642 discloses an apparatus for pressing items of clothing which has a flexible inflatable body and devices for inflating the inflatable body. With the aid of the inflatable body, items of clothing which are to be pressed can be tensioned from the inside and pressed in this way. The inflatable body here is subjected to wear as a result of the items of clothing being placed in position and removed. The inflatable body is preferably made of a thin material, although the durability is disadvantageously reduced as a result. In order to improve the pressing action, the item of clothing which is to be pressed is pulled over the inflatable body preferably in the damp state and dried there under tensioning. This, in turn, results in the inflatable body also becoming damp and, in the case of items of clothing which have been washed, residues of detergents pass, with the moisture, into the inflatable body. In order to remove residues of detergent or other contaminants, it is possible for a removable inflatable body to be washed. The inflatable body material is subjected to severe stresses as a result.

SUMMARY OF THE INVENTION

It is accordingly an object of the invention to provide a covering for an apparatus for pressing items of clothing with a flexible inflatable body, and also an apparatus for pressing items of clothing with an inflatable body which overcomes the above-mentioned disadvantages of the heretofore-known devices and methods of this general type and which helps achieve an increased service life of the assembly.

With the foregoing and other objects in view there is provided, in accordance with the invention, a covering for the inflatable body of an apparatus for pressing items of clothing. The covering is air-permeable at least over part of a its surface.

In accordance with a preferred embodiment, the covering material has a predetermined cut adapted to an item of clothing to be pressed or is formed in a standard clothing size, for adjusting at least one of a shaping of the inflatable body and a pressure distribution of the inflatable body to the item of clothing to be pressed.

With the above and other objects in view there is also provided, in accordance with the invention, an apparatus for pressing items of clothing, comprising an inflatable body and a changeable covering as summarized above.

Using a covering can protect the inflatable body. On the one hand, the abrasion is reduced since the item of clothing which is to be pressed only comes into contact with the covering and only rubs on the latter when being pulled on and removed. In addition, the covering acts as a buffer zone which can absorb moisture from the item of clothing which is to be pressed, together with any residues of detergent and contaminants which may be contained therein. The covering reduces the loading based on the pressure prevailing in the interior of the inflatable body and thus the mechanical loading of the inflatable body, which results in the service life of the inflatable body being extended.

The covering has to be capable of transmitting the outwardly directed pressure of the inflatable body in the outward direction and of directing to the item of clothing which is to be pressed the air which flows out of the inflatable body. All that is necessary for this purpose is for the covering to be air-permeable and to be capable of withstanding the surface pressure of the inflatable body. These requirements can be met by any air-permeable woven fabric. In contrast to this, the inflatable body also has to be tension-resistant since it has to be capable of withstanding the inflating pressure without an item of clothing pulled onto it. Furthermore, the inflatable body has to have devices for air-tight connection to the inflating devices. The covering is of considerably more straightforward configuration and is thus more cost-effective, and can be supplied in particular in a considerably more cost-effective manner, than an inflatable body. It is thus possible to define the covering as a displaceable article which, following a certain period of time, can be replaced by a new one. It is possible, for example, for the covering to be produced from a nonwoven material, or a fleece.

The material which can be used for the covering may be non-expandable and/or elastic. In the case of a covering made of a non-expandable material, the size variation is limited and it is also possible to press items of clothing for which pressure from inside would be disadvantageous, these items of clothing being, in particular, knitted articles, which would otherwise widen too far. If the covering, in contrast, is of elastic configuration, it is thus possible to achieve size adaptation within a certain range dependent on the elasticity.

The covering is preferably air-permeable over its entire surface area, with the result that the item of clothing which is to be pressed can be uniformly subjected to the action of air and dried. If the item of clothing is of irregular thickness over its surface area, it may be advantageous to provide the covering with irregular air permeability over its surface area. In particular, the air permeability of the different regions of the covering may be adapted to differently thick or quick-drying regions of a certain type of item of clothing which is to be pressed. For example, in the case of men's shirts, the shoulder areas and the region extending therebetween on the back are usually double-layered. This results in the shirt being more difficult to dry here. The same applies to the cuffs.

For the purpose of pressing men's shirts, it is thus possible to configure a covering such that, at the locations on which the cuffs or the shoulder areas rest, it has a higher level of air permeability than the rest of the surface area. Using different coverings, it is thus possible to adapt the amount of air discharged to the different items of clothing, with the result that the latter can be dried uniformly. Quicker drying can thus be achieved in certain circumstances since, as a result of the reduction in the air throughput at locations at which the material dries more quickly, the air throughput at other locations, at which the material dries more slowly, can be increased and the drying at these locations can thus be accelerated. The energy consumption can always be reduced since it is possible to reduce the amount of heat or air which is discharged unnecessarily to locations of the item of clothing which has already been dried. It is likewise possible to configure a shirt-like covering specifically for short-sleeved shirts such that the ends of the sleeves are not air-permeable, since the air which passes out of the inflatable body at these locations cannot in any case act on part of a short-sleeve shirt.

The covering is preferably smooth on the outside. Situations where impressions which adversely affect the pressing result are produced in the woven fabric of the item of clothing which is to be pressed can thus be avoided. The same also applies if the covering is smooth on the inside. In addition, by virtue of a covering which is smooth on the inside, the inflatable body is protected and the risk of the inflatable body being damaged by the covering is reduced. The covering is thus advantageously smooth both on the inside and on the outside.

In an advantageous embodiment, the covering can be washed. Contaminants can thus easily be removed from the covering, with the result that the items of clothing which are to be pressed are not accidentally soiled during the pressing operation. In particular residues of detergent which have been introduced into the covering by items of clothing which have been washed can be removed from the covering by virtue of the latter being washed.

In a development, it is conceivable for the covering to have arrangements for adjusting its dimensions. The covering can thus be adjusted to the dimensions of an item of clothing, with the result that the pressing result is improved since the item of clothing can be tensioned with fewer creases. In addition to the arrangements for adjusting the dimensions of the covering, provision may be made for the covering to be produced from an at least slightly elastic material. This would make it possible to achieve a lower level of crease formation as a result of pulling when the dimensions are adjusted. If the covering is produced from a non-elastic material, then the inflatable body can be precisely limited or adjusted to a maximum size or a certain shape (pattern, cloth size) by means of the covering, with the result that, for example, knitted articles, such as pullovers and the like, can be dried without them becoming misshapen. It is also possible for the covering to be produced from an expandable material, with the result that the covering can be used to compensate for variations in size, in a certain range, of the items of clothing which are to be pressed.

If the covering is configured such that its dimensions can be adjusted, the excess material necessarily forms creases. These are advantageously arranged such that they do not result in impressions in the item of clothing which is to be pressed. For this purpose, the excess material can be folded in such that it has the smallest possible number of folds or it can be folded in at a location at which it does not come into contact with the woven fabric of the item of clothing which is to be pressed or it comes into contact with the same at a location at which there is no possibility of any impressions, or at least of any obvious impressions, arising. For example, the material can be folded in at a seam of the item of clothing which is to be pressed or at an addition device for fixing the button strip and/or buttonhole strip of a shirt.

It is possible to provide fastening devices for connection between inflatable body and covering. The covering can thus be prevented from slipping on the inflatable body. Such fastening devices may be, for example, buttons, which interact with buttonholes, or touch-and-close fasteners. In addition, it is also conceivable to provide, on the inside of the covering and/or on the outside of the inflatable body, a non-slip coating, also referred to as no-skid, which enhances the friction between the covering and the inflatable body and thus prevents the covering from slipping on the inflatable body. It is likewise possible for the covering to be fastened on a part of the apparatus other than the inflatable body. For this purpose, the covering can be fastened on a bottom part, beneath the inflatable body, by means of pulling strips.

An apparatus for pressing items of clothing with an inflatable body, which is also intended to be used with a covering, may have a control means which, for the case of operation with a covering pulled over, provides for operation which is adapted thereto. For this purpose, the control means may have an input device by means of which the presence of a covering or of a mode of operation with the covering can be set. In the case of operation which is adapted thereto, the inflating pressure, in particular, can be elevated in order, despite the covering, to achieve an unchanged level of air throughput through the inflatable body.

The covering can enclose the inflatable body completely, although it may also extend only over part of the inflatable body. A covering for use for pressing items of clothing of a certain type advantageously covers the regions of the inflatable body which are covered by the items of clothing of this type.

Other features which are considered as characteristic for the invention are set forth in the appended claims.

Although the invention is illustrated and described herein as embodied in a covering for an inflatable body of an apparatus for pressing items of clothing, and apparatus for pressing items of clothing which is equipped therewith, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

FIG. 3 is a schematic front view of the inflatable body of the apparatus according to FIG. 1 with a covering according to a second embodiment;

FIG. 4 is a schematic front view of the inflatable body of the apparatus according to FIG. 1 with a covering according to a third embodiment;

FIG. 5 is a partial section showing a fabric structure of the covering provided with one smooth surface and one rough surface;

FIG. 6 is a partial section showing the covering material formed of fleece (non-woven); and FIG. 7 is a partial section showing the covering material formed of fleece (non-woven) and provided with an anti-slip coating on one surface.

DESCRIPTION OF THE PREFERRED EMBODIMENTS

Figure 1:
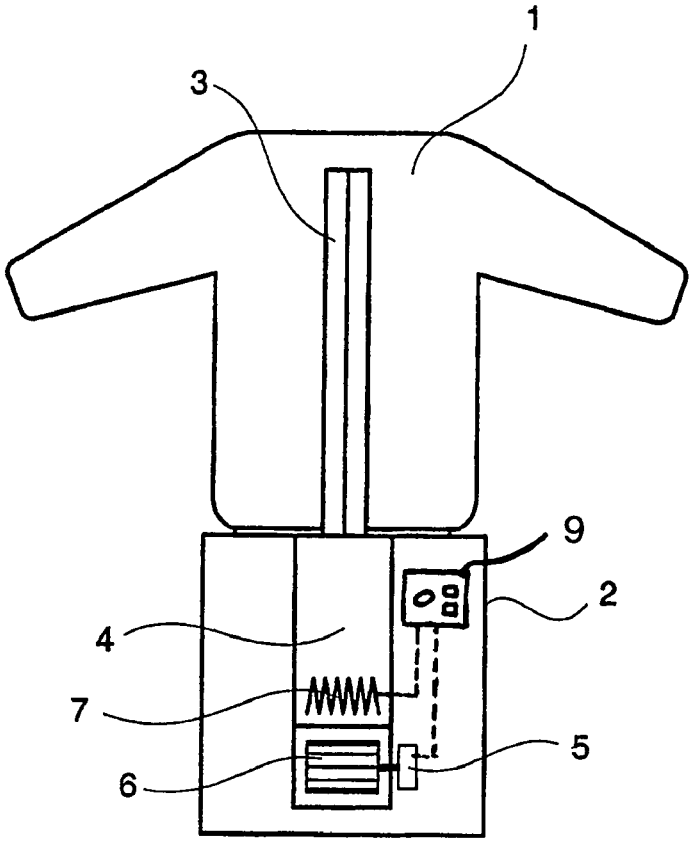
FIG. 1 is a schematic front elevational view of an apparatus according to the invention for pressing items of clothing with an inflatable body.

Referring now to the figures of the drawing in detail and first, particularly, to FIG. 1 thereof, the apparatus of the invention serves for pressing shirt-like items of clothing. The apparatus, which may be referred to as a shirt pressing apparatus, has a bottom part 2 with an inflatable body 1 fastened thereon. The inflatable body 1, which is also referred to as a pressing dummy, is shirt-like and consists of a non-rigid and selectively air-permeable material.

The bottom part 2 contains a fan 6 which is driven by a motor 5 and can blow air into the inflatable body 1 through an air channel 4. Furthermore, the air channel 4 contains an electric heater 7 by means of which the air blown into the inflatable body 1 can be heated. The apparatus further includes a control unit 9 with an input device for operating the apparatus. The input, for example, allows setting different modes of operation with the covering, including one mode in which the inflatable body 1 is inflated at an elevated pressure and/or with higher or lower temperature.

The bottom part 2, furthermore, carries a button-strip clamp 3 which extends at a small distance in front of the inflatable body 1, longitudinally in relation to the latter. The button-strip clamp 3 is used, in the operation of pressing shirts which are generally open at the front, for fixing the button strip and the buttonhole strip of a shirt which is to be pressed, in order that the shirt remains closed at the front when the inflatable body 1 is inflated.

Figure 2:
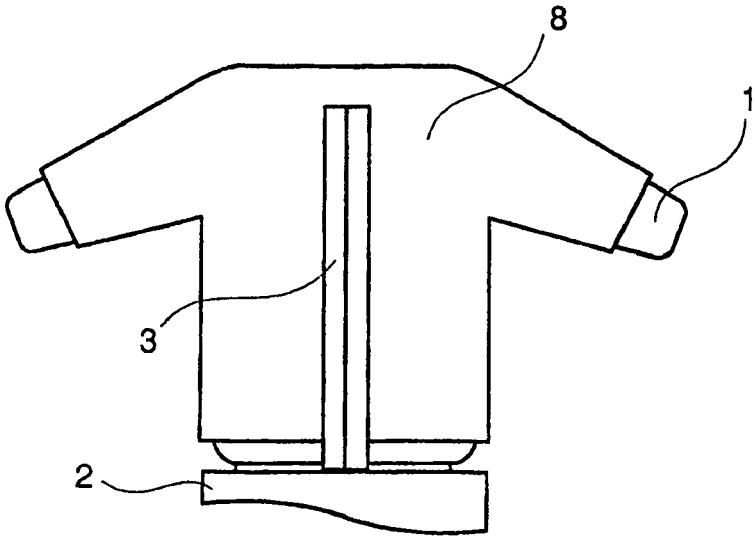
FIG. 2 is a schematic front view of the inflatable body of the apparatus according to FIG. 1 with a covering according to a first embodiment of the invention.

FIG. 2 illustrates the top part of the apparatus. It is possible to see here the inflatable body 1, the button-strip clamp 3 and a top section of the bottom part 2, a covering 8 having been pulled over the inflatable body 1. The covering 8 is in substantially the same form as the inflatable body 1 and consists of an air-permeable, thin and non-rigid material. The covering 8 advantageously consists of a low-cost nonwoven material. The covering 8, according to a first embodiment, is designed predominantly as a protective covering which is intended to reduce the wear on the inflatable body 1. For this purpose, the covering 8 is dimensioned such that it is the same size as the inflatable body, the covering 8 illustrated having shorter sleeve sections, which are open at the ends. This is admissible since the covering 8, rather than having to build up any air pressure, only has to act as an air-permeable intermediate layer. The length of the sleeve sections of the covering 8 is dimensioned such that it is longer than that of the longest sleeve of a shirt-like item of clothing which is to be pressed.

In order for it to be possible for the covering 8 to be pulled over the inflatable body 1, a gap is present between the button-strip clamp 3 and the inflatable body 1 at least when the covering 8 is pulled on. If the button-strip clamp 3 is connected at its top end, for the purpose of increasing the stability, to a framework arranged within the inflatable body 1, this connection is advantageously of releasable configuration, in order for it to be possible for the covering 8 to be pulled on. If the connection cannot be released, the covering 8 may be configured such that it can be opened on one side, with the result that it can be fed through between the inflatable body 1 and the button-strip clamp 3, and positioned around the inflatable body, in the open state and then closed again.

In order that the covering 8 does not significantly change the dimensions of the inflatable body 1, and nevertheless butts closely and without creasing against the inflatable body 1, the covering 8 may be of elastic configuration. An elastic covering 8 can also be used in order to moderate the outwardly directed tensioning force of the inflatable body 1. This may be advantageous, for example, in the case of items of clothing which yield easily when subjected to high tensioning from the inside.

FIG. 3 shows a covering 8 according to a second embodiment, in which the covering 8 is used in order to reduce the dimensions of the inflatable body 1. This may be advantageous for pressing small items of clothing in the case of which the inflatable body 1 develops, within the item of clothing which is to be pressed, a large number of creases which can butt against the inside of the woven fabric of the item of clothing and give rise to impressions. The latter can show on the outside and impair the pressing result. With the aid of the smaller covering 8, a smooth surface butts against the inside of the woven fabric of the item of clothing and it is not possible for any inner abutting creases to show through. This embodiment serves, in particular for pressing short-sleeved shirts and thus has shortened sleeve sections. On account of the shorter sleeves, which are open at the front, the covering 8 according to the second embodiment has a smaller surface area, is of more straightforward shape and can thus be produced more cost-effectively.

In an embodiment which is not illustrated, the covering 8 may also be provided in a shape which differs from that of the inflatable body 1. This may be advantageous in the case of items of clothing in which an inflating pressure which acts uniformly over the inner surface area does not give an optimum pressing result, as may be the case, for example, with blouses having unusual cuts. Furthermore, a fair number of items of clothing have regions which, in order to be pressed correctly, require pressure to be applied from the outside, as is the case during ironing with a pressing iron. This may be, for example, in regions in which the woven fabric is positioned in folds and has been sewn in this state. Such a region may be, for example, the transition between a wide sleeve and a cuff. In such a case, the covering 8 may be configured such that it only inflates to a certain extent, if at all, in these regions. These regions can then be pressed conventionally using an iron.

The fourth embodiment of the covering 8, which is illustrated in FIG. 4, likewise reduces the dimensions of the inflatable body 1, but, in contrast with the third embodiment above, has closed sleeves. This has the advantage that less air is lost at the ends of the sleeve sections of the inflatable body 1, which cannot be utilized in any case for pressing part of the item of clothing.

The covering is advantageously provided as an accessory, a range of different sized coverings being available in accordance with customary clothes sizes, e.g. SX, S, M, L, X, XL, XXL. It is also possible for the covering to be made available in predetermined cuts which influence the shaping of the pressing dummy.

The partial sections of FIGS. 5-7 illustrate various embodiments of the covering material. The covering material may be a fabric that has one smooth surface and one rough surface, as illustrated in FIG. 5. In a preferred embodiment, the covering material is non-woven fleece material. In yet a preferred embodiment, the covering material—whether fleece or woven fabric—may be provided with a no-slip coating. Such a coating may also be provided on the inflatable body.

I claim:

1. In an apparatus for pressing items of clothing having a non-rigid inflatable body comprising a selectively air-permeable material, a covering comprising a covering material being air-permeable at least over part of a surface thereof and configured to substantially surround the inflatable body and to function as an intermediate layer between the inflatable body and the clothing.

2. The covering according to claim 1, wherein said covering material has a predetermined cut adapted to an item of clothing to be pressed or is formed in a standard clothing size, for adjusting at least one of a shaping of the inflatable body and a pressure distribution of the inflatable body to the item of clothing to be pressed.

3. The covering according to claim 1, wherein said covering material is formed of textile sheet structure.

4. The covering according to claim 3, wherein said textile sheet structure has a uniformly high level of air permeability.

5. The covering according to claim 3, wherein said textile sheet structure has non-uniform air permeability throughout different segments thereof, for setting mutually different air supply rates at respectively different sections of the item of clothing to be pressed.

6. The covering according to claim 1, wherein said covering material is a substantially non-elastic material.

7. The covering according to claim 1, wherein said covering material is a substantially elastic material.

8. The covering according to claim 1, wherein said covering material is partly elastic material and partly non-elastic material.

9. The covering according to claim 1, wherein said covering material has at least one of a substantially smooth inner surface and a substantially smooth outer surface.

10. The covering according to claim 1, wherein said covering material is a washable material.

11. The covering according to claim 1, wherein said covering material is a nonwoven material.

12. In an apparatus for pressing items of clothing having an inflatable body, a covering comprising a covering material being air-permeable at least over part of a surface thereof and configured to fit over the inflatable body, wherein said covering material is formed with a non-slip coating on an inside thereof for enhancing a friction between said covering material and the inflatable body.

13. The covering according to claim 1, further comprising adjusting devices for adjusting dimensions of said covering material.

14. The covering according to claim 1, further comprising fastening devices for fastening said covering material on the inflatable body.

15. The apparatus according to claim 1, further comprising means for inflating said inflatable body.

16. The apparatus according to claim 1, further comprising fastening devices on said inflatable body for fastening said covering thereon.

17. The apparatus according to claim 1, further comprising a control unit with an input device for setting a mode of operation of the apparatus.

18. The apparatus according to claim 17, wherein said control unit is configured to set a mode of operation of the apparatus with said covering pulled over said inflatable body and said inflatable body being inflated at a relatively elevated pressure.

19. The apparatus according to claim 1, further comprising a non-slip coating on an outer surface of said inflatable body, for enhancing a friction between said covering and said inflatable body.

* * * * *